US005980278A

United States Patent [19]

Winkler

[11] Patent Number: 5,980,278

[45] Date of Patent: Nov. 9, 1999

[54] WATER-TIGHT ELECTRICAL CONNECTOR

[75] Inventor: Philippe Winkler, Ermont, France

[73] Assignee: Societe d'Exploitation des Procedes Marechal (SEPM), Saint-Maurice Cedex, France

[21] Appl. No.: 08/865,991

[22] Filed: May 30, 1997

[30] Foreign Application Priority Data

May 31, 1996 [FR] France ..... 96 06711

[51] Int. Cl.[6] ..... H01R 13/44

[52] U.S. Cl. ..... 439/142; 439/271

[58] Field of Search ..... 439/271, 142, 439/144, 274, 275, 276, 277; 200/242

[56] References Cited

U.S. PATENT DOCUMENTS

| | | | |
|---|---|---|---|
| 4,037,907 | 7/1977 | Klimek et al. . | |
| 4,058,358 | 11/1977 | Carlisle . | |
| 4,173,385 | 11/1979 | Fenn | 439/277 |
| 4,197,959 | 4/1980 | Kramer | 439/142 |
| 4,712,861 | 12/1987 | Lukas et al. . | |
| 5,080,601 | 1/1992 | Mennekes et al. . | |
| 5,100,336 | 3/1992 | Burgess | 439/277 |
| 5,145,402 | 9/1992 | Plyler et al. . | |
| 5,324,208 | 6/1994 | Kodama et al. . | |
| 5,545,046 | 8/1996 | Masuda et al. . | |
| 5,743,752 | 4/1998 | Massebeuf | 439/142 |

FOREIGN PATENT DOCUMENTS

| | | |
|---|---|---|
| 460727 | 12/1991 | European Pat. Off. . |
| 2551272 | 3/1985 | France . |
| 9217952 | 5/1993 | Germany . |
| 9302393 | 5/1993 | Germany . |
| 4220716 | 1/1994 | Germany . |
| 4320540 | 1/1994 | Germany . |
| 1562152 | 3/1980 | United Kingdom . |
| 2061027 | 5/1981 | United Kingdom . |

*Primary Examiner*—Steven L. Stephan
*Assistant Examiner*—Javad Nasri
*Attorney, Agent, or Firm*—Greenblum & Bernstein, P.L.C.

[57] ABSTRACT

A waterproof electrical connection apparatus having a plug casing which is inserted into a socket casing. The socket casing is provided with a hinged protective cover which is movable between an open position and a closed position. The socket casing can be used as an outlet or the connector of an extension lead of an appliance coupler. The socket casing has on an upper portion an annular groove intended to receive a singular annular seal which extends from the groove in an axial direction. The annular seal has a hooked-shaped cross-section which extends towards the interior of the socket casing. The cover and the plug have meeting surfaces intended to come into contact with the seal when the cover is in a closed position and when the plug is coupled to the socket.

20 Claims, 4 Drawing Sheets

WATER-TIGHT ELECTRICAL CONNECTOR

BACKGROUND OF THE INVENTION

1. Field of the Invention

The present invention generally relates to a water-tight electrical connector. In particular, the present invention relates to a water-tight electrical connector which includes a socket adapted to receive a plug to electrically connect the plug and the socket, and which constitutes the base of a plug and socket outlet or a connector of an extension cord or an appliance coupler.

2. Background and Material Information

Electrical connector casings that include a hinged protective lid movable from an opened position to a closed, secured position are known. However, it is difficult to design these prior electrical connectors as water-tight electrical connectors because of the difficulty in maintaining tolerances between the various parts comprising the connector. Prior electrical connectors have used two flat annular seals designed to fit over the frontal rim of the base of the connector in order to provide a water-tight seal. In these prior electrical connectors, one seal is fitted into the cover and the other seal is fitted around a part of the plug.

In addition to the above, prior water-tight electrical connectors have not been adapted to a wide variety of electrical connection systems. In particular, there is a need for improved water-tight electrical connecters which may be used in mobile electrical connector sockets, or connectors of an extension cord or an appliance coupler.

SUMMARY OF THE INVENTION

In view of the above, the present invention, through one or more of its various aspects and/or embodiments is presented to accomplish one or more objectives and advantages, such as those noted below.

In accordance with an object of the present invention, a water-tight electrical connector having a pivotal cover is provided having a single seal disposed on the base or socket of the connector. According to another object of the invention, the electrical connector is adapted to provide a water-tight seal compatible with both the pivotal movement of the cover and with the translational movement of a plug inserted into the connector.

To achieve the above objects of the invention, there is provided a waterproof electrical connection apparatus comprising a socket casing having an annular groove, the annular groove disposed proximate to a rim of the socket casing; an annular seal disposed within the annular groove which projects from the annular groove in an axial direction, and has substantially a hooked-shaped cross-section turned toward the interior of the socket casing; a protective cover connected to the socket by a hinge to pivotally move from a first position to a second position which includes a support surface; and a plug casing including a periphery and a support surface formed around the periphery, which is insertable into the socket casing to be coupled in the socket casing. The annular seal comprises the only seal on the socket casing, plug casing and cover of the electrical connection apparatus. When the protective cover is in the second position and secured to the socket casing and when the plug casing is coupled to the socket casing, the support surface of the protective cover and the support surface of the plug casing are arranged to contact the annular seal.

According to another feature, the support surface of the protective cover and the support surface of the plug are arranged to contact with predetermined points of a curved portion of the annular seal. The support surface of the protective cover are formed as one of a frusto-conical surface and a cylindrical surface, and the support surface of the plug casing is formed parallel to a longitudinal axis of the plug casing. The annular groove may be formed to have a rectangular cross-section.

According to yet another feature, the annular groove is defined by an internal ledge and an external wall of the socket casing, the external wall having a longitudinal extension extending beyond the internal ledge in a longitudinal direction. The curved portion of the annular seal extends from the internal ledge towards the interior of the socket casing and when the protective cover is in the second position and secured to the casing and when the plug casing is coupled to the socket casing, and a portion of the protective cover and a portion of the plug casing contacts the curved portion of the annular seal.

According to still another feature, the longitudinal extension of the exterior wall widens out in the direction perpendicular to the longitudinal direction from a top to the bottom of the extension. In addition, the annular seal may comprise a peripheral rib provided on an external face of the curved portion of the annular seal which contacts an internal wall of the exterior wall of the socket casing.

According to yet another feature, a groove is formed on an exterior face of the annular seal at a base of the curved portion. Also, an end of the annular seal opposite the curved portion has a tapered edge formed on an exterior face of the annular seal.

According to another feature, the connector further comprises an annular ring surrounding the socket casing which covers a portion of the annular seal.

The above-listed and other objects, features and advantages of the present invention will be more fully set forth hereinafter.

BRIEF DESCRIPTION OF THE DRAWINGS

The present invention is further described in the detailed description which follows, by reference to the noted drawings by way of a non-limiting example of the preferred embodiment of the present invention, in which like reference numerals represent similar parts throughout the several views of the drawings, and wherein.

DETAILED DESCRIPTION OF THE PREFERRED EMBODIMENTS

Figure 1:
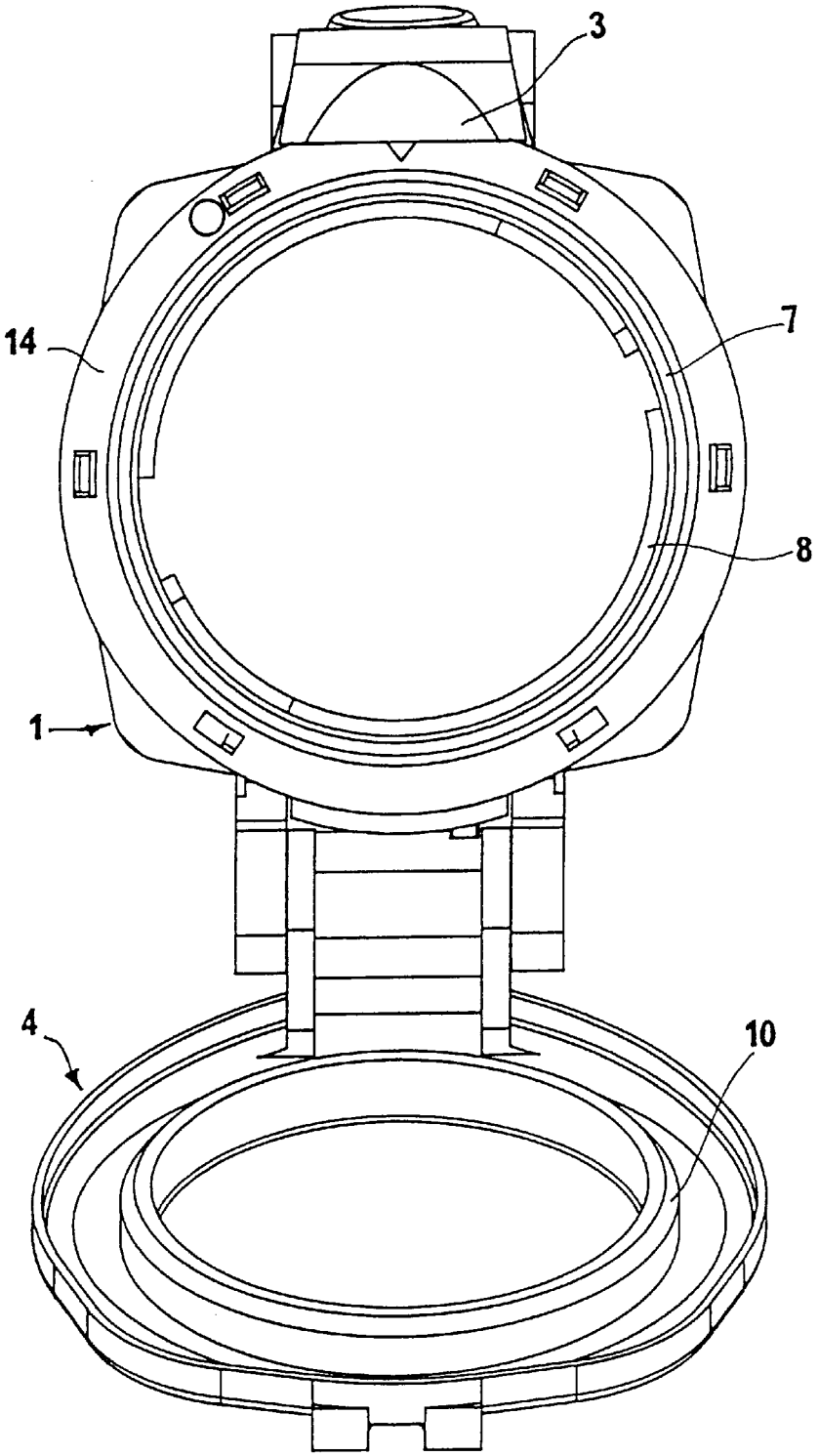
FIG. 1 is a top view a socket casing according to an embodiment of the present invention, with a cover in an open position.
Figure 2:
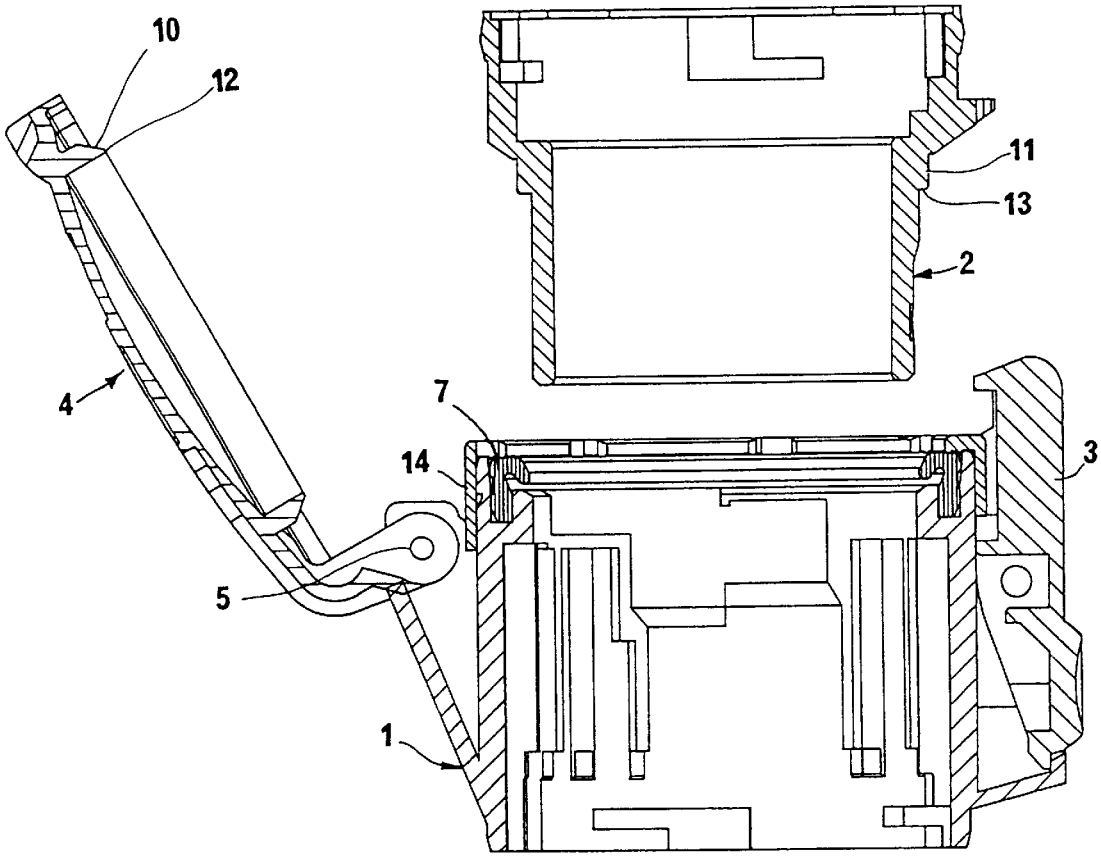
FIG. 2 is an sectional view of the casing of FIG. 1 with the cover in the opened position and the plug in a position to be inserted into the socket casing.

Referring now to FIGS. 1 and 2, the present invention, through its various features and aspects, includes a socket casing 1 which may house a socket (not shown) and a plug casing 2 which may house a plug (not shown). The plug may be plugged into the socket to electrically connect the plug and socket. Within the plug casing 2, there may be provided multiple contacts, e.g., pins, which under pressure contact corresponding contacts fitted in an insulating support arranged inside the socket casing 1. The plug and socket contacts do not form a part of the invention and are not shown in the Figs.

Figure 4:
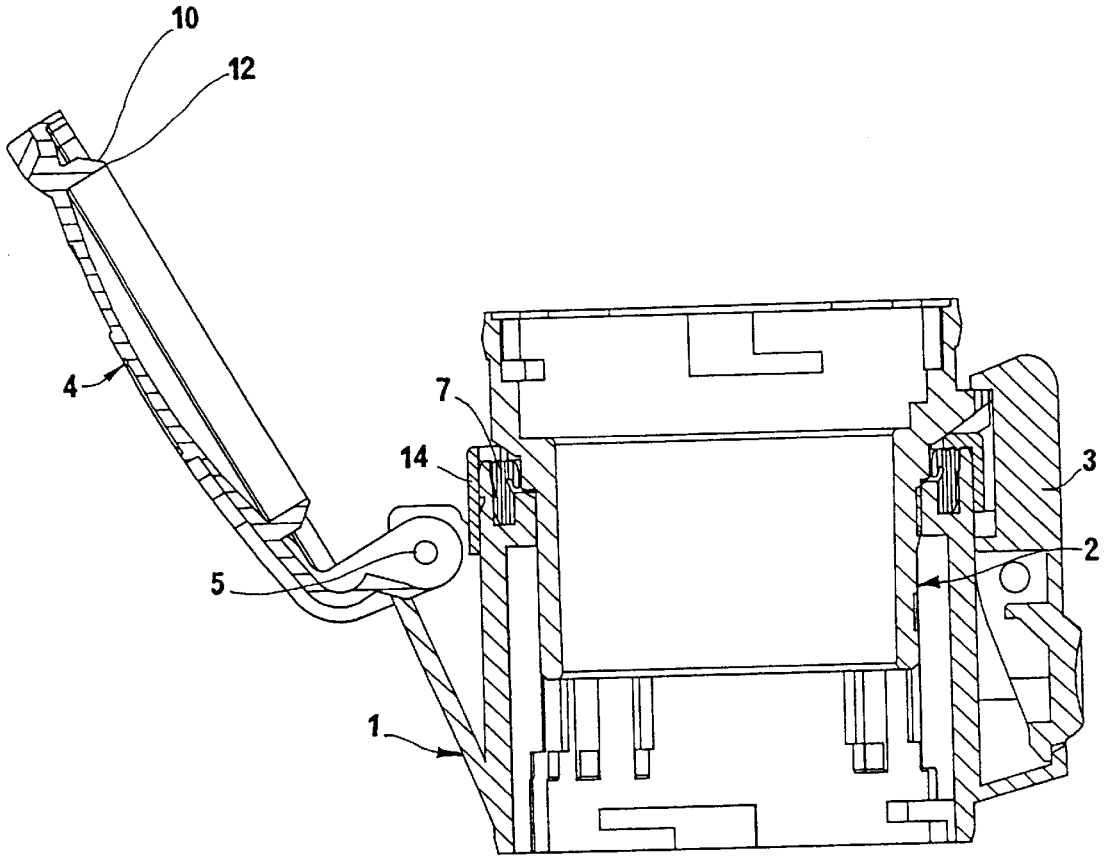
FIG. 4 is an sectional view of the casing of FIG. 1 with the cover in the opened position and the plug in an inserted position in the socket casing.
Figure 6:
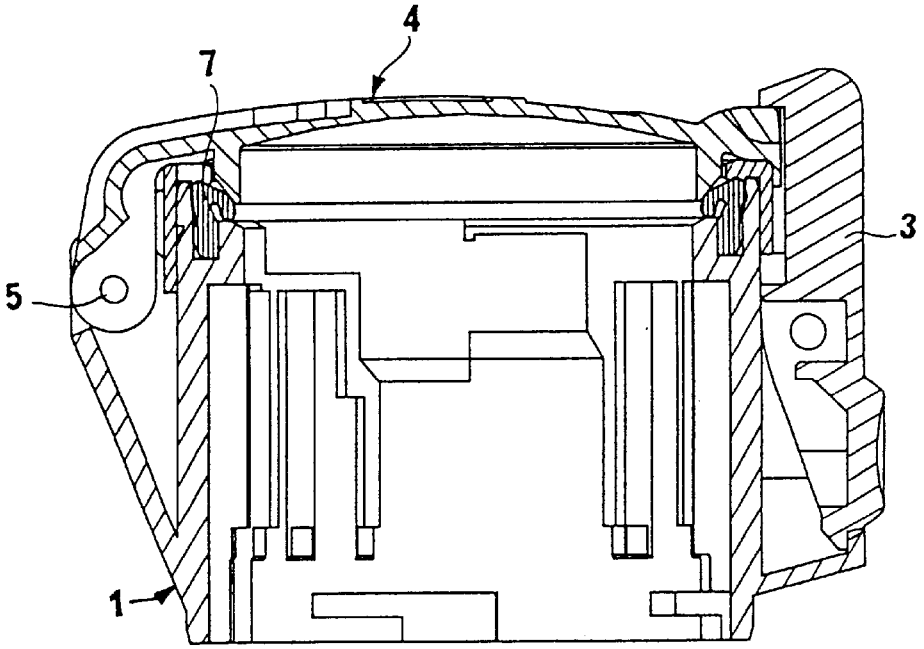
FIG. 6 is a sectional view of the casing of FIGS. 1–5 with the cover in a closed position.

As shown in FIGS. 2 and 4, a hook 3 is provided which contacts a corresponding part of the plug casing 2 to lock the plug casing 2 into the socket casing 1. The hook 3 is maintained in a locked position by a biasing force created by the plug and socket contacts and by the force of an ejection device (not shown) for ejecting the plug from the socket casing 1. The socket casing 1 is also provided with a cover 4 (FIGS. 1, 2, 4 and 6) which is pivoted about a pivot point 5 by a hinge. The pivot point 5 is located on an opposite side of the socket casing 1 relative to the hook 3. As shown by FIGS. 2 and 6, the cover 4 is pivotally movable and can be locked in a closed position by the hook 3. As shown in FIG. 4, the hook 3 also serves to lock the plug casing 2 in the inserted position.

Figure 3:
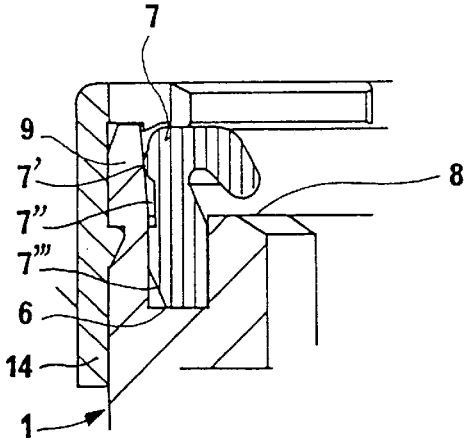
FIG. 3 is an enlarged view of a portion of the casing shown in FIG. 2.

Referring to FIGS. 2 and 3, at an inner periphery of the socket casing 1 a groove 6 is formed which receives an annular seal 7. The groove 6 has a rectangular section, and is bounded by an inner ledge 8, an outer external wall having a prolongation 9, and a bottom portion formed by the socket casing 1. As shown in FIG. 3, the prolongation 9 tapers outwardly with respect to the center of the socket casing 1 moving from the bottom to the top of the prolongation 9.

The annular seal 7 is inserted into the groove 6 and projects in a longitudinal direction with respect to the ledge 8. As illustrated in FIG. 3, the annular seal 7 has a generally hook-shaped sectional form that curves towards the interior of the socket casing 1. An external surface of the annular seal 7 defines a rib 7' proximate to an uppermost portion of the annular seal 7 which presses against the prolongation 9 of the groove 6. The annular seal 7 is provided with a groove 7" disposed below the rib 7' such that the annular seal 7 may be deformed or air trapped in the groove 6 may be expelled. Also, a tapered tail 7'" is provided at the base of the annular seal 7 under the groove 7" to provide for easy insertion of the annular seal 7 into the groove 6.

The annular seal 7 may be held in place by a ring 14 which is fastened to the socket casing 1 (for example by clipping), and which partially covers the top of the seal 7 to press the seal in a downward direction with respect to the socket casing 1. By covering a top part of the seal 7, the ring 14 additionally provides for a pleasing aesthetic appearance when the cover 4 is in the open position, as shown in FIG. 1.

As shown in FIGS. 2 and 4, the cover 4 and the plug casing 2 are provided with supporting surfaces 10 and 11, respectively, which contact the seal 7. The terminating portions of the supporting surfaces 10 and 11 are indicated by a point 12 and a shoulder 13, respectively. The supporting surface 10 of the cover 4 may be provided as a frusto-conical shape which converges towards the interior of the socket casing 1 when the cover 4 is in the closed position as viewed from the back towards the front of the supporting surface 10. The supporting surface 11 of the plug casing 2 may be cylindrical about an axis parallel to the longitudinal axis of the plug casing 2, i.e., an axis in the direction of plugging the plug casing 2 into the socket casing 1. Alternatively, the supporting surfaces 10 and 11 may both be provided as cylindrical or fruto-conical surfaces, or may be cylindrical and frusto-conical, respectively (i.e., opposite of the exemplary structure above).

As can be understood from the drawings, the supporting surface 10 of the cover initially contacts the annular seal 7 at the side on which the cover 4 is pivotally mounted (i.e., closer to the pivot point 5), whereas the surface 11 of the plug casing 2 contacts substantially the entire interior surface of the seal 7 as the plug casing is inserted into the socket casing 1.

As shown in FIGS. 4–7, when the cover 4 is the closed position or when the plug casing 2 is in the inserted position, i.e., after being locked into place by the hook 3, the supporting surfaces 10 and 11 of the cover 4 and of the plug casing 2, respectively, contact the curved interior portion of the annular seal 7, which deforms by closing in on itself. Also, the point 12 of the cover 4 and the shoulder 13 of the plug casing 2 come into close proximity with, or may contact, the ledge 8 of the socket casing 1.

Figure 5:
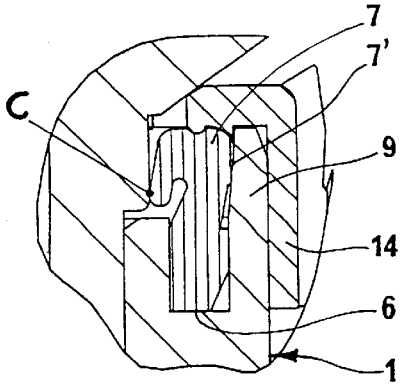
FIG. 5 is an enlarged view of a portion of the casing and the plug shown in FIG. 4.
Figure 7:
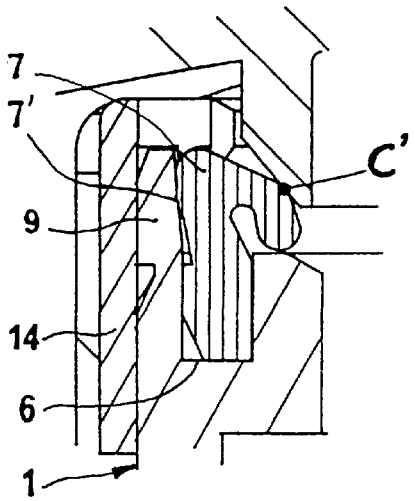
FIG. 7 is an enlarged portion of the casing and the plug shown in FIG. 6.

As shown in FIGS. 5 and 7, the contact between the supporting surfaces 10 and 11 and the seal 7 occurs at points C and C', respectively, in accordance with the resilience of the seal, whereas the seal 7 contacts the groove 6 in a plurality of positions and, more particularly, contacts the external wall of the groove 6 with the rib 7', thus assuring good water-tight seal.

The socket casing 1 may be used as a base of an outlet, and also may be used as a mobile socket which is connected to a plug connector or to the plug of an extension cable.

While the invention has been described with reference to an exemplary embodiment, it is understood that the words which have been used herein are words of description and illustration, rather than words of limitations. Changes may be made, within the purview of the disclosure, as presently stated and as amended, without departing from the scope and spirit of the invention in its aspects. For example, while the exemplary embodiment discloses a casing which is used as a base housing a socket of the connector or the extension cable, the casing may contain the plug rather than the socket.

This application is related to French Patent Application 9606711, filed May 31, 1996, to which priority is claimed, and the entire disclosure of which is hereby incorporated by reference.

What is claimed:

1. A waterproof electrical connection apparatus, comprising:

a socket casing having an annular groove, said annular groove disposed proximate to a rim of said socket casing;

an annular seal disposed within said annular groove, said annular seal projecting from said annular groove in an axial direction, and said annular seal having substantially a hooked-shaped cross-section curved towards the interior of said socket casing, said hook-shaped cross-section being structured and arranged so that said seal closes in on itself;

a protective cover connected to said socket by a hinge to pivotally move from a first position to a second position, said cover including a support surface; and a plug casing including a periphery and a support surface formed around said periphery, said plug casing being insertable into said socket casing to be coupled in said socket casing;

wherein said annular seal comprises the only seal of said socket casing, said plug casing and said protective cover, and when said protective cover is in said second position and secured to said socket casing and when said plug casing is coupled to said socket casing, said support surface of said protective cover and said support surface of said plug casing are arranged to contact said annular seal so that said seal closes in on itself.

2. The electrical connection apparatus according to claim 1, wherein said support surface of said protective cover and said support surface of said plug are arranged to contact predetermined points of a curved portion of said annular seal.

3. The electrical connection apparatus according to claim 2, wherein said support surface of said protective cover is formed as one of a frusto-conical surface and a cylindrical surface.

4. The electrical connection apparatus according to claim 2, wherein said annular groove has a rectangular cross-section.

5. The electrical connection apparatus according to claim 1, wherein said support surface of said plug casing is formed parallel to a longitudinal axis of said plug casing.

6. The electrical connection apparatus according to claim 1, wherein said annular groove has a rectangular cross-section.

7. The electrical connection apparatus according to claim 1, further comprising an annular ring, said annular ring surrounding said socket casing and covering a portion of said annular seal.

8. The electrical connection apparatus according to claim 1, wherein said support surface of said protective cover is formed as one of a frusto-conical surface and a cylindrical surface.

9. The electrical connection apparatus according to claim 4, wherein said support surface of said plug casing is formed parallel to a longitudinal axis of said plug casing.

10. The electrical connection apparatus according to claim 9, wherein said annular groove is defined by an internal ledge and an external wall of said socket casing, said external wall having a longitudinal extension extending beyond said internal ledge in a longitudinal direction, wherein said curved portion of said annular seal extends from said internal ledge towards the interior of said socket casing, and when said protective cover is in said second position and secured to said casing and when said plug casing is coupled to said socket casing, a portion of said protective cover and a portion of said plug casing contacts said curved portion of said annular seal.

11. The electrical connection apparatus according to claim 10, wherein said longitudinal extension of said exterior wall widens out from back to front over a portion of said longitudinal extension in the longitudinal direction.

12. The electrical connection apparatus according to claim 2, wherein said annular seal comprises a peripheral rib provided on an external face of said curved portion of said annular seal, said peripheral rib contacting an internal wall of said exterior wall of said socket casing.

13. The electrical connection apparatus according to claim 12, wherein a groove is formed on an exterior face of said annular seal at a base of said curved portion.

14. The electrical connection apparatus according to claim 13, wherein an end of said annular seal opposite said curved portion has a tapered edge formed on an exterior face of said annular seal.

15. The electrical connection apparatus according to claim 2, wherein said annular groove is defined by an internal ledge and an external wall of said socket casing, said external wall having a longitudinal extension extending beyond said internal ledge in a longitudinal direction, wherein said curved portion of said annular seal extends from said internal ledge towards the interior of said socket casing, and when said protective cover is in said second position and secured to said casing and when said plug casing is coupled to said socket casing, a portion of said protective cover and a portion of said plug casing contacts said curved portion of said annular seal.

16. The electrical connection apparatus according to claim 15, wherein said longitudinal extension of said exterior wall widens out from back to front over a portion of said longitudinal extension in the longitudinal direction.

17. The electrical connection apparatus according to claim 15, further comprising an annular ring, said annular ring surrounding said socket casing and covering a portion of said annular seal.

18. The electrical connection apparatus according to claim 15, wherein said annular seal comprises a peripheral rib provided on an external face of said curved portion of said annular seal, said peripheral rib contacting an internal wall of said exterior wall of said socket casing.

19. The electrical connection apparatus according to claim 18, wherein a groove is formed on an exterior face of said annular seal at a base of said curved portion.

20. The electrical connection apparatus according to claim 19, wherein an end of said annular seal opposite said curved portion has a tapered edge formed on an exterior face of said annular seal.

* * * * *